US009169095B2

(12) United States Patent
Haapanen et al.

(10) Patent No.: US 9,169,095 B2
(45) Date of Patent: Oct. 27, 2015

(54) METHOD AND DEVICE FOR WINDING OF FIBER WEBS, ESPECIALLY OF PAPER AND BOARD WEBS

(71) Applicants: Jaakko Haapanen, Järvenpää (FI); Henry Virta, Kerava (FI); Heikki Föhr, Järvenpää (FI)

(72) Inventors: Jaakko Haapanen, Järvenpää (FI); Henry Virta, Kerava (FI); Heikki Föhr, Järvenpää (FI)

(73) Assignee: Valmet Technologies, Inc., Espoo (FI)

( * ) Notice: Subject to any disclaimer, the term of this patent is extended or adjusted under 35 U.S.C. 154(b) by 190 days.

(21) Appl. No.: 13/862,998

(22) Filed: Apr. 15, 2013

(65) Prior Publication Data

US 2013/0270383 A1 Oct. 17, 2013

(30) Foreign Application Priority Data

Apr. 16, 2012 (EP) ..... 12164212

(51) Int. Cl.

| | |
|---|---|
| ***B65H 18/08*** | (2006.01) |
| ***B65H 18/16*** | (2006.01) |
| ***B65H 18/26*** | (2006.01) |

(52) U.S. Cl.

CPC ..... *B65H 18/08* (2013.01); *B65H 18/16* (2013.01); *B65H 18/26* (2013.01); *B65H 2301/4148* (2013.01); *B65H 2301/41486* (2013.01); *B65H 2301/414863* (2013.01); *B65H 2301/5155* (2013.01); *B65H 2511/216* (2013.01); *B65H 2515/815* (2013.01); *B65H 2801/84* (2013.01)

(58) Field of Classification Search

CPC ..... B65H 2301/41486; B65H 2301/4148; B65H 19/2284

USPC ..... 242/530, 530.1, 530.4, 525.1

See application file for complete search history.

(56) References Cited

U.S. PATENT DOCUMENTS

| | | | |
|---|---|---|---|
| 2,460,694 | A | 2/1949 | Haswell |
| 3,091,412 | A | 5/1963 | Chambon |
| 3,386,677 | A | 6/1968 | Becker |
| 3,792,824 | A | 2/1974 | Meyer et al. |
| 4,105,170 | A | 8/1978 | Schönmeier |
| 4,440,356 | A | 4/1984 | Lang |

(Continued)

FOREIGN PATENT DOCUMENTS

| | | | |
|---|---|---|---|
| DE | 4424848 | A1 | 1/1996 |
| DE | 19649354 | A1 | 6/1998 |

(Continued)

OTHER PUBLICATIONS

European Search Report for EP12164212 dated Aug. 8, 2012.

*Primary Examiner* — Sang Kim
(74) *Attorney, Agent, or Firm* — Stiennon & Stiennon

(57) ABSTRACT

A method and apparatus for winding fiber webs, particularly paper and board webs, in which partial web rolls (R1, R2) are wound in a winding device having at least two winding stations (21, 22), where partial webs (W1, W2) are guided to rolls (R1, R2) via a nip between a winding roll(s) (12, 41, 42) and the partial web rolls (R1, R2). The partial webs (W1, W2) are guided on the surface of the winding roll(s) (12, 41, 42) before entering the nips creating a wrap angle (A1, A2) on the winding drum(s) (12, 41, 42). The wrap angles (A1, A2) of the partial webs onto the surface of the winding roll (12, 41, 42) is at least 120° and the wrap angle ratio, i.e. the relation of the larger wrap angle to the smaller wrap angle, is at least 1 and at most 1.25.

6 Claims, 3 Drawing Sheets

(56) References Cited

U.S. PATENT DOCUMENTS

| | | | |
|---|---|---|---|
| 4,508,283 | A | 4/1985 | Beisswanger |
| 4,550,887 | A | 11/1985 | Schonmeier |
| 4,601,435 | A | 7/1986 | Tomma et al. |
| 5,364,044 | A | 11/1994 | Welp et al. |
| 5,405,099 | A | 4/1995 | Hehner et al. |
| 5,961,065 | A | 10/1999 | Tomma et al. |
| 6,007,014 | A | 12/1999 | Krüger |
| 6,012,673 | A | 1/2000 | Kayser et al. |
| 6,234,419 | B1 | 5/2001 | Hehner et al. |
| 6,241,178 | B1 | 6/2001 | Schönmeier et al. |

FOREIGN PATENT DOCUMENTS

| | | | |
|---|---|---|---|
| EP | 0478719 | A1 | 10/1991 |
| EP | 0711245 | A1 | 5/1996 |
| EP | 0818409 | A1 | 1/1998 |
| EP | 0829438 | A2 | 3/1998 |
| EP | 0873959 | A2 | 10/1998 |
| EP | 1657193 | A1 | 5/2006 |
| EP | 12164212 | | 4/2012 |
| EP | 12164937 | | 4/2012 |
| WO | 9855383 | A1 | 12/1998 |
| WO | 03106313 | A1 | 12/2003 |
| WO | 2012056096 | A1 | 5/2012 |

METHOD AND DEVICE FOR WINDING OF FIBER WEBS, ESPECIALLY OF PAPER AND BOARD WEBS

CROSS REFERENCES TO RELATED APPLICATIONS

This application claims priority on European App. No. EP12164212, filed Apr. 16, 2012, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method and device for winding of fiber webs, especially paper and board webs, into partial web rolls which are wound via a nip between a winding roll and the roll being formed on a winding station from a parent roll.

The invention also relates to a device for winding fiber webs, particularly paper and board webs, into partial web rolls, which device includes a winding station for winding partial web rolls via a nip between a winding roll and the roll being formed.

It is known that a fiber web, e.g. paper, is manufactured in machines which together constitute a paper-manufacturing line which can be hundreds of meters long. Modern paper machines can produce over 450,000 tons of paper per year. The speed of the paper machine can exceed 2,000 m/min and the width of the paper web can be more than 11 meters.

In paper-manufacturing lines, the manufacture of paper takes place as a continuous process. A paper web completed in the paper machine is reeled by a reel-up around a reeling shaft i.e., a reel spool, into a parent roll the diameter of which can be more than 5 meters and the weight more than 160 tons. The purpose of reeling is to modify the paper web manufactured as planar to a more easily processable form. On the reel-up located in the main machine line, the continuous process of the paper machine breaks for the first time and shifts into periodic operation.

The web of parent roll produced in paper manufacture is full-width and even more than 100 km long so it must be slit into partial webs with suitable width and length for the customers of the paper mill. The web from the parent roll is slit and wound around cores into so-called customer rolls before delivering them from the paper mill. This slitting and winding up of the web takes place as known in an appropriate separate machine i.e., a slitter-winder.

On the slitter-winder, the parent roll is unwound, the wide web is slit on the slitting section into several narrower partial webs which are wound up on the winding section around winding cores, such as spools, into customer rolls. When the customer rolls are completed, the slitter-winder is stopped and the rolls i.e. the so-called set is removed from the machine. Then, the process is continued with the winding of a new set. These steps are repeated periodically until paper runs out of the parent roll, whereby a parent roll change is performed and the operation starts again as the unwinding of a new parent roll.

Slitter-winders employ winding devices of different types depending on, inter alia, the type of the fiber web being wound. On slitter-winders of the multistation winder type, the web is guided from the unwinding via guide rolls to the slitting section where the web is slit into partial webs which are further guided to the winding roll/rolls on the winding stations into customer rolls to be wound up onto cores. Adjacent partial webs are wound up on different sides of the winding roll/rolls. Multistation winders have one to three winding rolls and in them each partial web is wound to a partial web roll in its own winding station. During winding a winding nip is formed between the winding roll and the partial web roll to be wound. The winding nip tightens the web in the nip and at a wrap area, that is the area the web runs on the surface of the winding roll. The tightening increases when the winding roll has a soft coating. If the length of the wrap is not long enough, the web will slide on the surface of the winding roll. In case partial webs next to each other have wrap of different length, the result is a difference of tension of partial webs, which causes runnability problems and differences in tightness of the partial web rolls. Attempts have been made in the prior art to solve this by using a tension interruption roll at the winding roll but they have proven unreliable and they also require a lot of maintenance.

Thus when winding up webs on winding stations, it is important that the web stays fast without sliding on the surface of the winding roll when entering the winding nip of the winding station, whereby the tension of the entering web remains in control. If/when sliding in practice occurs, it is important that possible circumferential distances of different lengths of the partial webs i.e. wrap angles of different sizes on the periphery of the winding roll are either eliminated or, if this is not possible, tension differences of the partial webs caused by the surrounding distances of different lengths one may try to compensate by means of the winding technique using different winding parameters. If sliding on different winding stations is different, the partial web rolls are formed different in their hardness.

On some slitters of the multistation winder type known of prior art, the winding up of partial webs occurs on both sides of one winding roll, having the diameter of typically 1,200 mm or 1,500 mm. For instance, specification EP O478719 (U.S. Pat. No. 5,405,099) describes a known winder of a slitter-winder where the winding up of partial webs occurs on both sides of the winding roll and the circumferential distances of partial webs are different on the winding stations positioned on different sides of the winding roll. As a solution for this, patent specification EP O478719 describes the use of a separate so-called tension interruption roll. By the tension interruption roll, the partial webs are locked onto the surface of the winding roll thus aiming to eliminate the effect of sliding. When the web tension provided by the unwinding device is this way interrupted before winding up, the winding up requires additional devices, e.g. center drives of winding stations, which then again provide the web with tension required for winding up. Such a method is not cost-effective in terms of power consumption.

On some other multistation winder types known of prior art, the so-called three-roll winders, which are described e.g. by patent specification F171708 (U.S. Pat. No. 4,601,345) and patent specification U.S. Pat. No. 4,508,283, the winding up of partial webs occurs by means of two winding rolls, typically having the diameter of 850 mm or 1,000 mm, and a guide roll positioned between them. Partial webs are guided separate from each other before guiding to the winding rolls. F171708 describes a winder of a slitter-winder where winding arms are pivoted whereby, as the roll diameter increases, the winding nip transfers on the periphery of the winding roll, i.e. the wrap angle of the web on the winding roll changes. U.S. Pat. No. 4,508,283 describes winders of a slitter-winder where the winding stations are above the winding roll and suspended on a robust cross beam in the cross-machine direction and their support requires massive structures above the winding roll. In these kinds of winders, the roll surrounding distances of partial webs guided on different sides of the winder are optimized such that the distances on the periphery of the winding rolls and the periphery of the guide roll are substantially the same on the winding stations on both sides of the slitter-winder. To ensure uniform winding, the winding rolls and the guide roll are mechanically connected together and this group is driven by one electric motor. The partial web rolls to be wound are supported by arms that move the web roll in relation to the winding roll as the diameter of the partial web roll increases during winding. These kinds of arrangements prerequisites a tight mutual diameter tolerance in the manufacture of winding and guide rolls and support arms of the web rolls, thus making the manufacture of the winder require high precision.

In U.S. Pat. No. 2,460,694 is disclosed a prior art winder with two winding rolls. In this arrangement the partial web rolls to be wound are supported by arms that move the web roll in relation to the winding roll as the diameter of the partial web roll increases during winding and thus the wrap angle changes during winding whereby, as the roll diameter increases, the winding nip transfers on the periphery of the winding roll, i.e. the wrap angle of the web on the winding roll changes.

SUMMARY OF THE INVENTION

An object of the invention is to create a device and a method for winding fiber webs where the problems relating to sliding of the partial webs on winding roll/winding rolls have been eliminated or at least minimized.

An object of the invention is to create a device and a method for winding fiber webs where the problems due to the tension differences of the partial webs on winding roll/winding rolls have been eliminated or at least minimized.

An object of the invention is to provide a device and a method for winding fiber webs where the result of the winding is the best possible and similar in all simultaneously wound partial web rolls.

According to the invention a method and a device for winding of partial webs a multistation winder type with one winding roll or advantageously with two winding rolls is used where the wrap angle on each winding roll is at least 120° and wrap angle relation, i.e. relation of the larger wrap angle to the smaller wrap angle is at least 1 and at most 1.25. This provides that in sliding situation partial webs on winding roll/winding rolls behave in a similar manner and thus sliding does not create problems in winding in different winding stations.

By the invention in the winding the large wrap angle in combination to the wrap angle relation of 1-1.25 results that sliding problems are minimized and the tension of the partial webs directed to different winding stations provides for good runnability and simultaneously partial web rolls to be wound will be free of tightness problems. The invention also provides for a large range of available running parameters due to the solved sliding problems.

According to an advantageous feature of the invention, winding up occurs utilizing the mass of the roll and, as the roll diameter increases, its center moves linearly at a certain angle in relation to the winding roll, whereby the position of the nip remains stationary. The winding stations are sturdily supported on the machine level floor or equivalent foundation.

According to an advantageous additional characteristic of the invention, the winding stations are directly supported on the floor, thus providing them an extremely good and stable support without massive support structures above the machine floor level.

Next, the invention will be described in more detail with reference to the figures of the enclosed drawing, to the details of which the invention is intended by no means to be narrowly limited.

DESCRIPTION OF THE PREFERRED EMBODIMENTS

Figure 1:
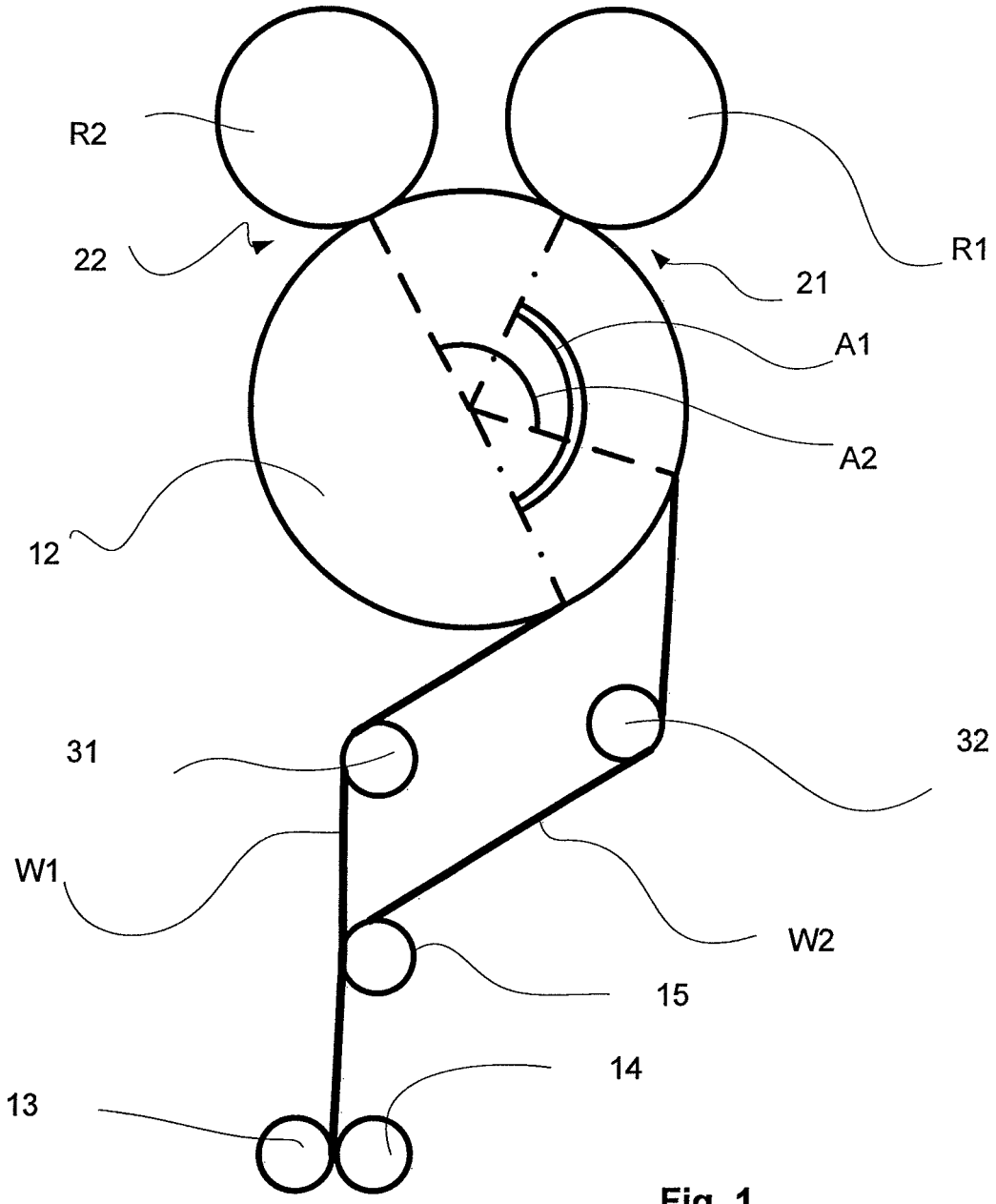
FIG. 1 is a side elevational schematic view showing an exemplifying embodiment of the invention in which one winding roll is used.

FIG. 1 schematically shows an exemplifying embodiment of the invention in which one winding roll 12 is used. A web is guided for example from an unwinding station (not shown) in between slitter blades 13, 14 or laser or water jet slitting means which slit the web W in the longitudinal direction into partial webs W1, W2. By reference sign W1 are indicated those partial webs that will be guided from the guide roll 15 via another guide roll 31 to the first winding station 21 to be wound into first partial web rolls R1 and by reference sign W2 are indicated those partial webs that will be guided from the guide roll 15 via another guide roll 32 to a second winding station to be wound into second partial web rolls R2. The partial webs W1, W2 are wound into partial web rolls R1, R2 via the winding roll 12 on respective winding station 21, 22. Each partial web roll is created around a core or equivalent winding spool. Substantially all partial webs W1, W2 pass via the first guide roll 15 and every first partial webs W1 are guided to the guide roll 31 and the winding up thus occurs via winding roll 12 at the first winding stations 21. From the guide roll 15 the other every second partial webs W2 are guided via guide roll 32 to be wound up via winding roll 12 on second winding stations 22. The wrap angle that the partial webs are on the surface of the winding roll, in the figure between lines A1, A2, respectively for each winding station 21, 22 is at least 120° and the wrap angle relation, i.e. relation of the larger wrap angle to the smaller wrap angle is at least 1 and at most 1.25.

Figure 2:
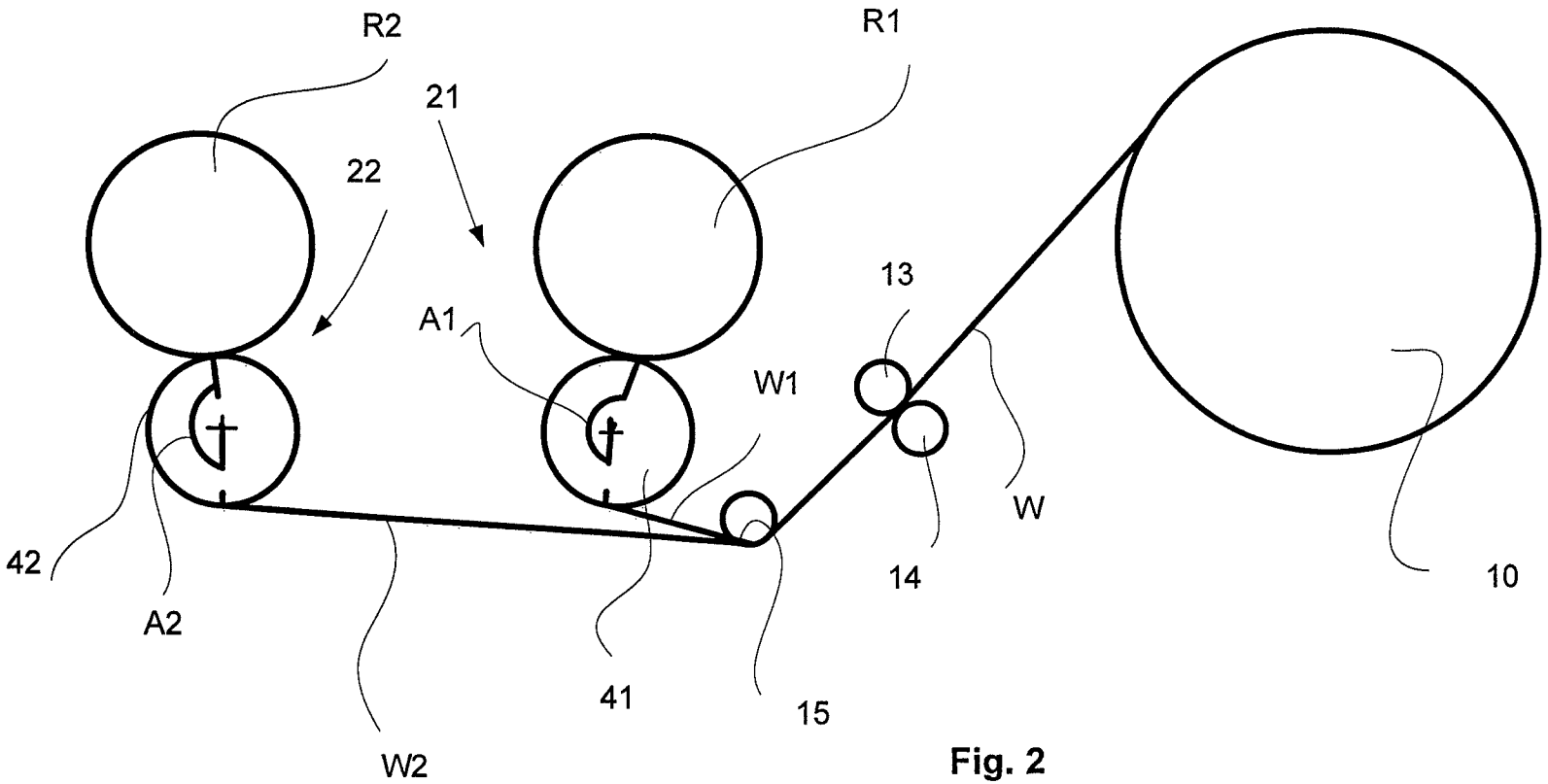
FIG. 2 is a side elevational schematic view showing an exemplifying embodiment of the invention in which two winding rolls are used.

FIG. 2 schematically shows an exemplifying embodiment of the invention in which two winding rolls 41, 42 are used. A web W is guided for example from an unwinding station 10 in between slitter blades 13, 14 or laser or water jet slitting means which slit the web W in the longitudinal direction into partial webs W1, W2. By reference sign W1 are indicated those partial webs that will be guided from the guide roll 15 to the first winding station 21 to be wound into first partial web rolls R1 and by reference sign W2 are indicated those partial webs that will be guided from the guide roll 15 to the second winding station 22 to be wound into second partial web rolls R2. The partial webs W1, W2 are wound into partial web rolls R1, R2 via the winding rolls 41, 42 on respective winding station 21, 22. Each partial web roll is created around a core or equivalent winding spool. Substantially all partial webs W1, W2 pass via the first guide roll 15 and every first partial webs W1 are guided to the winding roll 41 of the first winding station 21 and the winding up thus occurs via winding roll 12 at the first winding stations 21. From the guide roll 15 the other every second partial webs W2 are guided to be wound up via the second winding roll 42 on second winding stations 22. The wrap angle that the partial webs are on the surface of the winding roll 41, 42 in the figure between lines A1, A2, respectively for each winding station 21, 22 is at least 120° and the wrap angle relation, i.e. relation of the larger wrap angle to the smaller wrap angle is at least 1 and at most 1.25.

Figure 3:
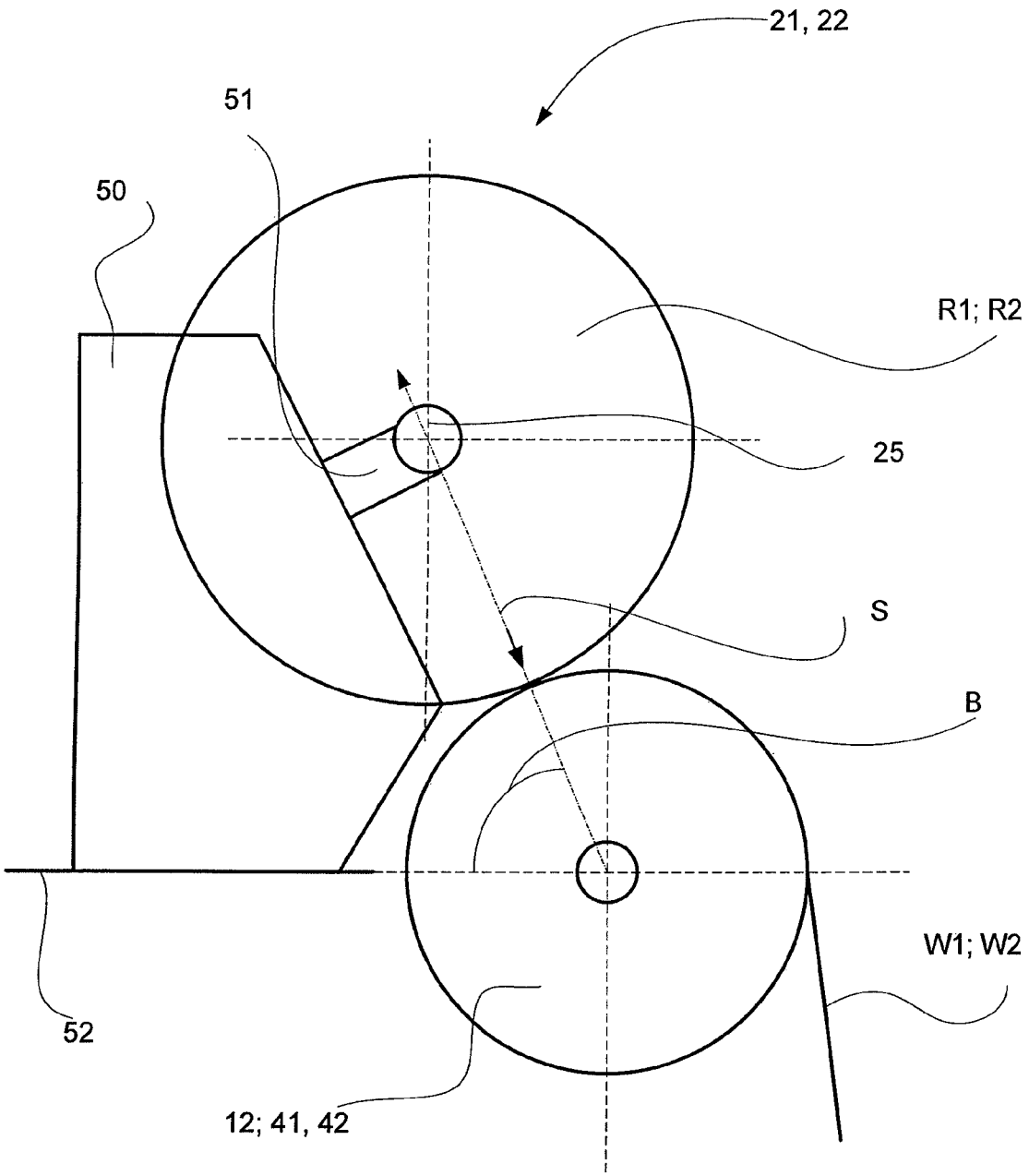
FIG. 3 is a side elevational schematic view showing an example of a winding station supported on a floor.

FIG. 3 schematically shows an example of a winding station 21; 22 supported on the floor 52. The figure shows a winding roll 12, partial webs guidable to the winding roll 12 are designated with reference W1; W2. The partial webs W1, W2 are wound into partial web rolls R1; R2 via the winding roll 12 in the winding station 21, 22. The winding stations 21, 22 are supported on a floor 52 or equivalent foundation, and the web rolls R1; R2 are attached to the winding station linearly movably via a support arm 51 or equivalent. The web roll is created around a core 25 or equivalent winding spool which is connected from its center to the support arm 51. As the web roll diameter increases as the winding proceeds, the growing web roll moves linearly in a direction shown by arrow S at a certain angle B in relation to the winding roll 12, which is shown in FIG. 3 by an arrow S. The support angle B of the roll is larger than 0 degrees and smaller than or equal to 90 degrees, most advantageously 45-90 degrees. When the web rolls R1; R2 are completed, it is easy to release them from the winding station 21; 22 and to deliver the set i.e. to remove the completed partial web rolls R1; R2 from the winding roll 12, because the winding stations 21; 22 are supported on the floor 52 or equivalent foundation structure, whereby the periphery of the web rolls is positioned close to the level of the floor 52. The winding up of partial webs W1; W2 into partial web rolls R1; R2 occurs utilizing the mass of the partial web roll, as the partial web roll supports itself advantageously at least in part on the winding roll 12 below. Hence, the mass of the partial web roll advantageously provides the nip load, required for winding, between the winding roll 12 and the partial web roll R1. The other part of the mass of the web roll R1, which is not supported on the winding roll is supported by winding chucks (not shown) of the support arm 51, wherein the winding chucks support a core 25 about which the partial web rolls R1 is wound, and supported about its center.

The winding stations 21; 22 according to FIG. 3 are advantageously positioned in connection with the winding roll 12 in the example of FIG. 1 and in connection with both winding rolls 41,42 in the example of FIG. 2. In connection with the example of FIG. 2, naturally, the winding station 22 in connection with the second winding roll 42 is substantially a mirror image in relation to the winding station 21 being in connection with the first winding roll 41.

The invention was described above referring to only some of its advantageous exemplifying embodiments to the details of which the invention is not intended to be narrowly limited but many modifications and variations are possible.

We claim:

1. A method for winding a paper or board web, comprising the steps of:

guiding the paper or board web from an unwinding station in between slitter blades which slit the web in a longitudinal direction into a first partial web and a second partial web;

winding in a winding device at a first winding station, the first partial web into a first partial web roll;

wherein the first partial web is guided to the first partial web roll via a first nip between a winding roll and the first partial web roll;

wherein the first partial web is guided on a surface of the winding roll starting at a first position on the surface of the winding roll, and from the first position wraps the surface of the winding roll along a first wrap angle which is at least 120° before entering the first nip in the first winding station;

winding in the winding device at a second winding station, the second partial web into a second partial web roll;

wherein the second partial web is guided to the second partial web roll via a second nip between the winding roll and the second partial web roll;

wherein the winding roll defines a wrapping direction, in which the first partial web and the second partial web are wrapped on the winding roll;

wherein the second partial web is guided on the surface of the winding roll starting at a second position on the surface of the winding roll, and from the second position to wrap the surface of the winding roll along a second wrap angle which is at least 120° before entering the second nip in the second winding station;

wherein the second position is separated in the wrapping direction from the first position; and wherein a ratio of the first wrap angle and the second wrap angle is at least 0.8 and at most 1.25.

2. The method of claim 1 wherein the first partial web and the second partial web are both guided from the slitter blades via at least one guide roll;

wherein the first partial web is guided from the at least one guide roll via a second guide roll to the winding roll, and then to the first partial web roll in the first winding station; and wherein the second partial web is guided from the at least one guide roll via a third guide roll to the winding roll, and then to the second partial web roll in the second winding station.

3. The method of claim 1 wherein there are a plurality of first partial webs which are guided via the second guide roll to the first winding station; and a plurality of second partial webs which are guided via the third guide roll to the second winding station.

4. A device for winding paper or board webs, comprising:

an unwinder for a full-width web;

a slitter;

wherein the unwinder is arranged to supply the full-width web to the slitter;

wherein the slitter is arranged to slit the full-width web into at least a first partial web and a second partial web;

a winding roll having a winding roll surface;

wherein the winding roll is arranged to form a first winding station for winding the first partial web into a first partial web roll at a first nip;

wherein the winding roll is arranged to form a second winding station for winding the second partial web into the second partial web roll at a second nip;

a second guide roll arranged with respect to the winding roll surface to guide the first partial web onto the winding roll surface at least 120° before the first nip in the first winding station so as to wrap the first partial web starting at a first position on the surface of the winding roll, and from the first position wraps the first partial web about the winding roll surface with a first wrap angle of at least 120°;

a third guide roll arranged with respect to the winding roll surface to guide the second partial web onto the winding roll surface at least 120° before the second nip in the second winding station so as to wrap the second partial web starting at a second position on the surface of the winding roll, and from the second position wrap the second partial web about the winding roll surface with a second wrap angle of at least 120°;

wherein the winding roll is arranged to be driven to rotate in a wrapping direction, in which the first partial web and the second partial web are wrapped on the winding roll;

wherein the second position is separated in the wrapping direction from the first position; and wherein a ratio of the first wrap angle and the second wrap angle is at least 0.8 and at most 1.25.

5. The device of claim 4 wherein the slitter is arranged to supply the first partial web and the second partial web to at least one first guide roll; and wherein the at least one first guide roll is arranged to guide the first partial web to the second guide roll and the second partial web to the third guide roll.

6. The device of claim 4 wherein the first winding station is supported on a floor or foundation and the second winding station is supported on the floor or foundation.

* * * * *